US010047410B2

(12) United States Patent
Holicza

(10) Patent No.: US 10,047,410 B2
(45) **Date of Patent: *Aug. 14, 2018**

(54) METHODS OF PRESERVING HIDES

(75) Inventor: Peter J. Holicza, Vancouver (CA)

(73) Assignee: LEATHERTEQ LIMITED, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 12/950,110

(22) Filed: Nov. 19, 2010

(65) Prior Publication Data

US 2011/0064960 A1 Mar. 17, 2011

Related U.S. Application Data

(62) Division of application No. 12/541,084, filed on Aug. 13, 2009.

(60) Provisional application No. 61/106,471, filed on Oct. 17, 2008.

(51) Int. Cl.
*C14C 1/00* (2006.01)
*C14C 1/08* (2006.01)

(52) U.S. Cl.
CPC ..... *C14C 1/00* (2013.01); *C14C 1/08* (2013.01); *Y10T 428/4935* (2015.04)

(58) Field of Classification Search
CPC ..... C14C 1/00; C14C 1/08
USPC ..... 8/94.19, 94.21, 94.33; 428/540
See application file for complete search history.

(56) References Cited

U.S. PATENT DOCUMENTS

| | | | | |
|---|---|---|---|---|
| 1,927,910 | A | 9/1933 | Gerhard et al. | |
| 2,004,930 | A | 6/1935 | Connor | |
| 2,868,614 | A * | 1/1959 | Ushakoff | 8/94.18 |
| 2,917,833 | A * | 12/1959 | Kremen et al. | 8/94.1 D |
| 3,429,648 | A * | 2/1969 | Langley | 8/94.17 |
| 3,638,562 | A * | 2/1972 | Karaghiosoff | 100/118 |
| 4,039,281 | A | 8/1977 | Graf | |
| 4,147,511 | A | 4/1979 | Bartlett | |
| 4,224,028 | A | 9/1980 | Thiele | |
| 4,434,196 | A * | 2/1984 | Robinson et al. | 427/389 |
| 4,744,794 | A | 5/1988 | Friese et al. | |
| 4,889,811 | A * | 12/1989 | Christner et al. | 435/265 |
| 4,902,298 | A * | 2/1990 | D'Elia et al. | 8/94.33 |
| 4,935,031 | A | 6/1990 | Munch et al. | |
| 4,999,024 | A | 3/1991 | Scheen | |
| 5,820,633 | A * | 10/1998 | Lesko et al. | 8/94.21 |
| 6,022,383 | A | 2/2000 | Kuwabara et al. | |
| 6,092,301 | A | 7/2000 | Komanowsky | |
| 7,033,402 | B2 | 4/2006 | Saravanabhavan et al. | |
| 7,578,970 | B2 * | 8/2009 | Bowker | 422/28 |
| 2007/0022541 | A1 * | 2/2007 | Taeger et al. | 8/94.16 |

FOREIGN PATENT DOCUMENTS

| | | | |
|---|---|---|---|
| CN | 1034224 | A | 7/1989 |
| CN | 1061801 | A | 6/1992 |
| CN | 1087949 | A | 6/1994 |
| GB | 1138099 | * | 12/1968 |
| WO | WO 98/16663 | * | 10/1998 |

OTHER PUBLICATIONS

Derwent abstract 1996-115110.*
Farnham (Home tanning and leather making guide 1922).*
"Leather Science," Japan, edited by H. Okamura, published by Japanese Association of Leather Technology, Nov. 25, 1992, and partial English translation thereof.
English translated extracts from Wei Shilin, "Leather Technology," China Light Technology Press, 1st Edition, p. 148, lines 16-21 and p. 401, lines 2-5.
Leather Facts, Third Edition 1994, Dennis J. Laplume, et al., New England Tanners Club.

* cited by examiner

*Primary Examiner* — Mark S Kaucher
(74) *Attorney, Agent, or Firm* — Kirton McConkie; Evan R. Witt

(57) ABSTRACT

A method for preserving hides, skins and pelts prior to tanning, without salt-curing. The hides are fatliquored, pickled and dried, all prior to tanning. The method may include the preliminary steps of washing, fleshing, liming and unhairing followed by the steps of fatliquoring, deliming, bating, pickling and drying. The method avoids the environmental damage caused by salt-curing. The treated hides are dry, flexible and readily rehydrated for further processing.

22 Claims, No Drawings

METHODS OF PRESERVING HIDES

CROSS-REFERENCE TO RELATED APPLICATIONS

This is a divisional of application Ser. No. 12/541,084 filed Aug. 13, 2009, which is incorporated herein by reference, and claims the benefit of provisional application No. 61/106,471, filed Oct. 17, 2008.

TECHNICAL FIELD

The invention pertains to the preservation of hides, skins and pelts, and in particular to methods of preservation prior to tanning.

BACKGROUND

The process of manufacturing leather from hides has changed relatively little for many years, and the many steps that comprise the process are well known in the industry. In general terms, there are preliminary steps to preserve the hides and prepare them for tanning, followed by the steps of tanning and further processing. A typical sequence of steps in the preliminary, pre-tanning part of the process is curing with salt (sodium chloride), soaking and washing, deflesh-ing, liming, unhairing, bating and pickling.

The salt-curing of the hides, done as the first step, is carried out either by immersing the hides in a brine solution, by wet salting or by dry salting. The purpose of salt-curing is to retard spoilage prior to carrying out the remainder of the leather-making process. It is common in North America and many other parts of the world for hides to be preserved by salt-curing and then be shipped to overseas tanneries for the further processing and tanning.

Another common method of curing hides includes processing through the preliminary steps in the conventional manner and tanning with chromium sulphate, which results in a product termed wet blue, which is then further tanned, again, often at overseas tanneries. Even with this process, however, salt-curing may be done as a preliminary step.

The practice of salt-curing causes significant environmental damage. When the curing and the tanning are done at different facilities, this damage occurs in both places.

SUMMARY OF THE INVENTION

The invention provides a method for preserving hides prior to tanning, without the use of salt-curing, in which the hides are fatliquored prior to drying.

According to one embodiment, the hides are subjected to the steps of washing, fleshing, liming and unhairing, followed by the steps of fatliquoring, deliming, bating, pickling and lastly drying. Optionally, the preliminary steps may include splitting the hide.

According to another embodiment, the hides are subjected to the steps of washing, fleshing, liming, unhairing and deliming, followed by the steps of fatliquoring, bating, pickling and drying.

According to another embodiment, the hides are subjected to the steps of washing, fleshing, liming, unhairing, deliming and bating, followed by the steps of pickling using a portion of a pickling solution, fatliquoring, further pickling with the balance of the picking solution, and lastly drying.

The invention further provides a preserved, fatliquored, untanned hide. The hide may also be pickled or unhaired, or both. It may be made according to the methods of the invention.

It will be understood that the method of the present invention is a significant departure from conventional leather-making processes. Most importantly, the initial step of salt-curing of the hides is not required or done. The step of fatliquoring is carried out prior to any tanning of the hide, whereas in conventional processes it is generally done after the hide is tanned, not before. Also, the hide is dried after pickling, whereas in conventional processes, pickled hides are not dried prior to tanning.

The treated hides produced by the method of the invention are dry, flexible and readily rehydrated for further processing. They are easier to grade than hair-on, salted hides. They are much lighter in weight than salt-cured hides and therefore cheaper to ship. They do not include the waste by-products and the salt, present in salted hides, and therefore do not create disposal problems for the tanners.

These and other features of the invention will be apparent from the following description of the preferred embodiments.

DESCRIPTION OF THE PREFERRED EMBODIMENTS

In this specification and claims, the term "hide" is to be understood as including hides, skins and pelts. It is also to be understood that all weight percentages stated herein, unless otherwise specified, are relative to the weight of the hide being treated. Thus, for example, reference to fatliquoring with a fatliquor that is 5 weight % refers to the weight percent of the fatliquor relative to the weight of the hide being fatliquored.

In carrying out the methods of the invention, in addition to the steps of fatliquoring, pickling and drying, as described further herein, the hides are subjected to the conventional steps of washing, fleshing, liming, unhairing, optionally splitting, deliming and bating. Each of these conventional steps is well understood in the art of hide processing.

The key steps of the methods of the invention are the steps of fatliquoring, pickling and drying. Drying is done as the last of the steps of the methods, though additional steps, such as staking, can be done after drying.

The Preservation Method in which Fatliquoring is Done Prior to Deliming

In this embodiment of the preservation method, the hide is first prepared by the preliminary steps of washing, fleshing, liming and unhairing, the steps being typically, and preferably, carried out in that order. Optionally, the step of splitting is done, after unhairing. After unhairing or after splitting, if done, the hide is fatliquored using an anionic fatliquor. Then the steps of deliming, bating, pickling and lastly drying are done, preferably in that order. The steps of fatliquoring, pickling and drying are further described below.

The Preservation Method in which Fatliquoring is Done after Deliming

In this embodiment of the preservation method, the hide is first prepared by the preliminary steps of washing, fleshing, liming, unhairing and deliming, the steps being typically, and preferably, carried out in that order. Optionally, the step of splitting is done after unhairing and prior to deliming. After deliming, the hide is fatliquored, using an anionic fatliquor. Then, the steps of bating, pickling and lastly drying are done, preferably in that order. The steps of fatliquoring, pickling and drying are further described below.

The Method in which Fatliquoring is Done Between Two Steps of Pickling

In this embodiment of the preservation method, the hide is first prepared by the preliminary steps of washing, fleshing, liming, unhairing, deliming and bating, the steps being typically, and preferably, carried out in that order. Optionally, the step of splitting is done after unhairing and before deliming. After bating, the hide is pickled using a portion of the pickling solution, for example one-quarter of the total pickling solution to be used in the process. Then, the hide is fatliquored, using a cationic fatliquor. The hide is further pickled, using the balance of the pickling solution, for example three-quarters of the total pickling solution used in the process. Finally, the hide is dried. The steps of fatliquoring, pickling and drying are further described below.

The Step of Fatliquoring

Fatliquors are agents that lubricate, soften or make more flexible or pliable the fibers of hides or leathers. The application of such an agent is referred to herein as fatliquoring. Both anionic and cationic fatliquors can be used in the methods of the invention. Nonionic fatliquors may also be used but anionic and cationic ones are preferred. For the methods in which fatliquoring is done before bating, anionic fatliquors are preferred. For the method in which fatliquoring is done after bating, between the first and second parts of the pickling step, cationic fatliquors are preferred. Fatliquoring the hides is done in an aqueous solution of the fatliquor. Fatliquoring is done at concentrations of fatliquor from about 1 to 15 weight %, preferably 2 to 10 weight %, more preferably 5 to 10 weight % (relative to the weight of the hides being fatliquored). Processing times are in the range of 40 to 180 minutes. Preferred pH ranges are between 1 and 13, depending on the fatliquor used, and solution temperature ranges are between 25 and 50 degrees C.

The Step of Pickling

Pickling solutions conventionally used in the tanning industry comprise an aqueous solution of sodium chloride and acid. Such conventional pickling solutions can be used in the methods of the invention.

Pickling solutions that are preferred for use in the invention comprise aqueous solutions of formic acid, sulphuric acid and either sodium chloride, potassium chloride or a combination of both salts. The salt content is in the range of 3 to 15 weight % and the formic acid and sulphuric acid content each in the range of 0.5 to 5 weight % (all relative to the weight of the hide). One preferred pickling solution, referred to herein as "standard acid," comprises 7 weight % sodium chloride, 1 weight % formic acid and 1 weight % sulphuric acid. Another preferred pickling solution, referred to herein as "double acid," comprises 7 weight % sodium chloride, 2 weight % formic acid and 2 weight % sulphuric acid.

In order to reduce the amount of sodium chloride in the pickling solution, all or part of it can be replaced by potassium chloride. Thus, another preferred pickling solution comprises 3.5 weight % sodium chloride, 3.5 weight % potassium chloride, 2 weight % formic acid and 2 weight % sulphuric acid.

The Step of Drying

The step of drying, as used in the methods of the invention, is carried for two purposes. One is to reduce the weight of the treated hide. Since the treated hides are typically shipped elsewhere for tanning, reducing the weight lowers the shipping cost. The second reason is to aid in the preservation of the hides, as reducing the moisture content of the treated hides lessens their susceptibility to the growth of bacteria, molds and fungi. It will be understood that the treated hides do not need to be dried to a state of complete dryness. In the specification and claims, "drying" means reducing the moisture content to a desired level. The moisture level of the dried hides is typically up to about 25 weight %. Preferred moisture levels are in the range of 5 to 25 weight %, more preferably 10 to 15 weight %.

Drying can be carried out in several ways. It is possible to dry the hides simply by air drying, hanging the treated hides to dry in the open air until the desired moisture level is attained. For faster processing, however, mechanical drying means are employed. One means of drying is sammying, in which a wet hide is machine-wrung between felt-covered rollers. Another means of drying is vacuum drying, in which a hide is placed in a drying chamber under reduced air pressure. Another is toggle drying, in which hides are stretched on a rack with toggles at their edges and passed through a heating chamber.

Another drying method is solvent drying, in which a hide is treated with an organic solvent that drives out the water. The hides are immersed in the solvent for a time period typically in the range of 15 minutes to 4 hours. Various organic solvents may be used for this purpose. A preferred solvent comprises a solution of aliphatic hydrocarbons, fatty alcohol ethoxylate, glycol ether, n-methyl-2-pyrrolidone and orange terpenes. The solvents can be used in their concentrated form or diluted with water.

The step of drying can comprise a combination of these drying methods. For example, a first step of sammying can be followed by one or more of solvent drying, vacuum drying, toggle drying and air drying. Another combination is a first step of solvent drying, followed by sammying, followed by one or more of vacuum drying, toggle drying and air drying.

The Step of Splitting

It is common in the industry to split hides during the leather-making process, producing a grain split and a bottom split that are each further processed to produce leather having the desired characteristics. Splitting is an optional step in the method of the present invention. Typically, it would be done after unhairing and prior to deliming.

The Step of Staking

Staking is commonly done to leather during conventional leather-making processes. It consists of mechanically flexing the leather in order to improve its pliability. The step of staking the hide is an optional step in the method of the present invention. It would typically be done after the step of drying.

EXAMPLES

A raw, fresh cowhide weighing about 32 kg was subjected to the preliminary steps of washing, fleshing, liming, unhairing and splitting. The split hide weighed about 16 kg and was cut into four pieces, each weighing about 4 kg. These prepared samples were then processed as described in the following Examples. Weight percentages stated in the Examples are based on the weight of the piece of split hide being treated.

Example 1

A prepared sample of hide was processed by fatliquoring with 7% anionic fatliquor for 90 minutes at pH 8.5 and a temperature of 35 degrees C., then delimed, bated, pickled using standard acid, sammied and dried by means of air drying on a toggle unit.

Example 2

A prepared sample of hide was processed by deliming, then fatliquoring with 7% anionic fatliquor for 90 minutes at pH 8.5 and a temperature of 35 degrees C., then bated, pickled using standard acid and dried by means of air drying on a toggle unit.

Example 3

A prepared sample of hide was processed by deliming and bating. Then it was pickled using one-quarter of the quantity of standard acid, then fatliquored with 7% cationic fatliquor for 90 minutes at pH 3 and a temperature of 35 degrees C. Then it was further pickled using the remaining three-quarters of standard acid. It was then dried by means of air drying on a toggle unit.

The samples of hide processed in accordance with Examples 1 to 3 were folded and creased on a press at a pressure of 200 bar and 5 seconds dwell, to investigate the vulnerability of the hides in the dried state to grain damage. The samples were also tanned, retanned, dyed, fatliquored, set out and toggled to dry. They were then conditioned and stacked using a reciprocating machine. After dying, all the leathers were inspected under a microscope and there was no apparent grain damage on the fold line of any of the samples. The leathers made from the processed samples were tested for tensile strength on an Instron 336 machine. The results were all within an acceptable industrial range.

The samples processed in accordance with Examples 1 to 3 were also subjected to flex testing using a Bally flexometer. There was no grain damage after 20,000 cycles.

Although the invention has been described in terms of various embodiments, it is not intended that the invention be limited to those embodiments. Various modifications within the scope of the invention will be apparent to those skilled in the art. The scope of the invention is defined by the claims that follow.

What is claimed is:

1. A preserved, fatliquored, pickled, dried, untanned, non-salt cured hide made according to a method comprising the steps of fatliquoring in an aqueous medium, bating, pickling and lastly drying the hide to a moisture content in the range of 5 to 25 weight %, wherein the step of fatliquoring is carried out prior to the step of bating.

2. A preserved, fatliquored, pickled, dried, untanned, non-salt cured hide made according to a method comprising the steps of fatliquoring in an aqueous medium, bating, pickling and lastly drying the hide to a moisture content in the range of 5 to 25 weight %, wherein a first step of pickling is carried out after the step of bating, the step of fatliquoring is of carried out after the first step of pickling, a second step of pickling is carried out after the step of fatliquoring, and the step of drying is carried out after the second step of pickling.

3. A preserved hide according to claim 1, wherein the hide is subjected to preliminary steps comprising washing, fleshing, liming and unhairing, followed by the step of fatliquoring, a step of deliming and the steps of bating, pickling and lastly drying.

4. A preserved hide according to claim 1, wherein the hide is subjected to preliminary steps comprising washing, fleshing, liming, unhairing and deliming, followed by the steps of fatliquoring, bating, pickling and lastly drying.

5. A preserved hide according to claim 3, wherein the steps after the step of unhairing are carried out in the order: fatliquoring, deliming, bating, pickling and drying.

6. A preserved hide according to claim 4, wherein the steps after the step of deliming are carried out in the order: fatliquoring, bating, pickling and drying.

7. A preserved hide according to claim 1, wherein the step of fatliquoring is done with an anionic fatliquor.

8. A preserved hide according to claim 1, wherein the steps further comprise, after the step of pickling, a step of sammying.

9. A preserved hide according to claim 7, wherein the anionic fatliquor is 1 to 15% by weight relative to the weight of the hide.

10. A preserved hide according to claim 2, wherein the first step of pickling comprises using a portion of the pickling solution to be used in the method and the second step of pickling comprises using the remainder thereof.

11. A preserved hide according to claim 2, wherein the step of fatliquoring is done using a cationic fatliquor.

12. A preserved hide according to claim 11, wherein the cationic fatliquor is 1 to 15% by weight relative to the weight of the hide.

13. A preserved hide according to claim 1, further comprising a step of splitting.

14. A preserved hide according to claim 1, wherein the steps further comprise, after the step of drying, the step of staking.

15. A preserved hide according to claim 1, wherein the step of drying comprises:

(a) sammying; and (b) one of vacuum drying, toggle drying and air drying.

16. A preserved hide according to claim 1, wherein the step of pickling is done with a pickling solution comprising formic acid, sulfuric acid and one of sodium chloride or potassium chloride.

17. A preserved hide according to claim 1, wherein the step of pickling is done with a pickling solution comprising formic acid, sulfuric acid, sodium chloride and potassium chloride.

18. A preserved hide according to claim 16, wherein the pickling solution comprises the formic acid in an amount that is 0.5 to 5 wt % relative to the weight of the hide being pickled.

19. A preserved hide according to claim 16, wherein the pickling solution comprises the sulfuric acid in an amount that is 0.5 to 5 wt % relative to the weight of the hide being pickled.

20. A preserved hide according to claim 16, wherein the pickling solution comprises the sodium chloride or potassium chloride in an amount that is 3 to 15 wt % relative to the weight of the hide being pickled.

21. A preserved hide according to claim 17, wherein the pickling solution comprises the sodium chloride and the potassium chloride each in an amount that is 1.5 to 7.5 wt % relative to the weight of the hide being pickled.

22. A preserved, fatliquored in aqueous medium, pickled, dried to a moisture content in the range of 5 to 25 weight %, untanned, non-salt cured hide.

* * * * *